United States Patent [19]

Mayes

[11] 4,062,344

[45] Dec. 13, 1977

[54] FIREPLACE HEATING SYSTEM

[76] Inventor: C. C. Mayes, P.O. Box 8, Pigeon Forge, Tenn. 37863

[21] Appl. No.: 580,022

[22] Filed: May 22, 1975

[51] Int. Cl.[2] ..... F24B 1/18

[52] U.S. Cl. ..... 126/120

[58] Field of Search ..... 126/121, 131, 120, 122; 237/51

[56] References Cited

U.S. PATENT DOCUMENTS

| | | | |
|---|---|---|---|
| 715,914 | 12/1902 | Weidinger | 126/120 |
| 1,383,506 | 7/1921 | Westerlund | 126/121 |
| 1,587,227 | 6/1926 | Hallberg | 126/121 |
| 1,697,635 | 1/1929 | Cornelius | 126/121 |
| 2,231,258 | 2/1941 | Elmore | 126/121 |
| 2,622,587 | 12/1952 | Dupler | 126/121 |
| 3,945,369 | 3/1976 | Adams et al. | 126/121 |

FOREIGN PATENT DOCUMENTS

| | | | |
|---|---|---|---|
| 770,271 | 3/1957 | United Kingdom | 126/120 |

*Primary Examiner*—Ronald C. Capossela
*Attorney, Agent, or Firm*—Fitch, Even, Tabin & Luedeka

[57] ABSTRACT

A heating system including a fireplace and hood means interposed in substantially free standing relationship between the top opening of the fireplace and the bottom opening of a cooperating chimney, the hood means being dimensioned to be withdrawable through the top opening of the fireplace and having detachable flange means about its bottom peripheral edge to engage the top opening of the fireplace and provide support for the hood above the top opening of the fireplace. Housing means exterior to the hood is provided to enclose the space between the fireplace and the chimney to provide an air flow passageway exteriorly of the hood means. Duct means are provided to convey air through the passageway for heating and, thereafter, distribution to a remote location.

5 Claims, 22 Drawing Figures

FIREPLACE HEATING SYSTEM

This invention relates to a fireplace heating system, particularly such a system having novel air flow means for selectively controlling the source and quantity of air feeding a fire in the fireplace and for circulating air for heating it preparatory to its use in heating a predetermined region.

In general, fireplaces are inefficient as heating means due to the large portion of the heat produced by the fire passing through the chimney, and due to room heating occurring, in major portion, by radiated heat. Additionally, convection currents commonly transfer warm air from the room in which the fireplace is located through the fireplace and out through the chimney. Consequently, there has been a persistent need in the art for an efficient fireplace heating system.

It is an object of the present invention to provide an improved fireplace heating system. It is another object to provide a fireplace heating system which selectively controls the source and quantity of air feeding a fire in the fireplace. It is another object to provide a fireplace heating system having means for receiving unheated air from a selected source, heating the air, and passing it to a selected region to be heated. It is another object to provide a latch for a sliding panel in a fireplace heating system. Other objects will become apparent from the following description including the drawings in which:

The disclosed heating system includes a fireplace having a closure for the front opening thereof. This closure includes at least one upright panel adapted to be moved between open and closed positions with respect to the front opening of the fireplace. Movement of the panel regulates the flow of air through an air supply duct system interconnecting the fireplace and an outside air supply for selecting the source and quantity of air which feeds a fire in the fireplace. In one embodiment, hood means having an opening therethrough for directing flue gases from the fireplace out the chimney is disposed over the fireplace. This hood means, in combination with the fireplace walls, the chimney walls and a duct system, defines passageway means for receiving unheated air from a selected source, and moving the air past heated surfaces for heating the air preparatory to its introduction to an area to be heated, for example into a central heating system for distribution throughout a building.

Figure 1:
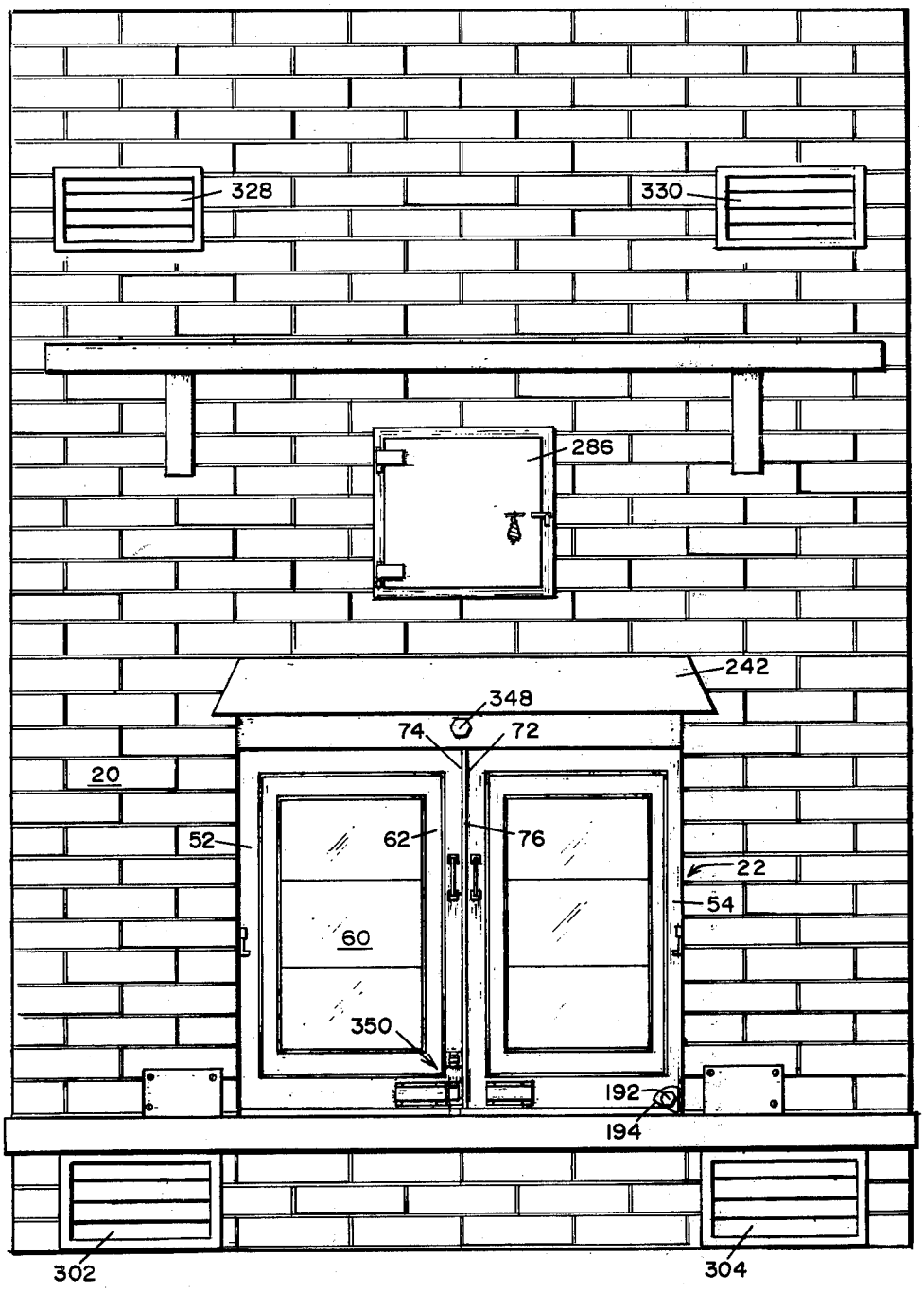
FIG. 1 is a front elevation view of a fireplace heating system embodying various features of the invention.
Figure 2:
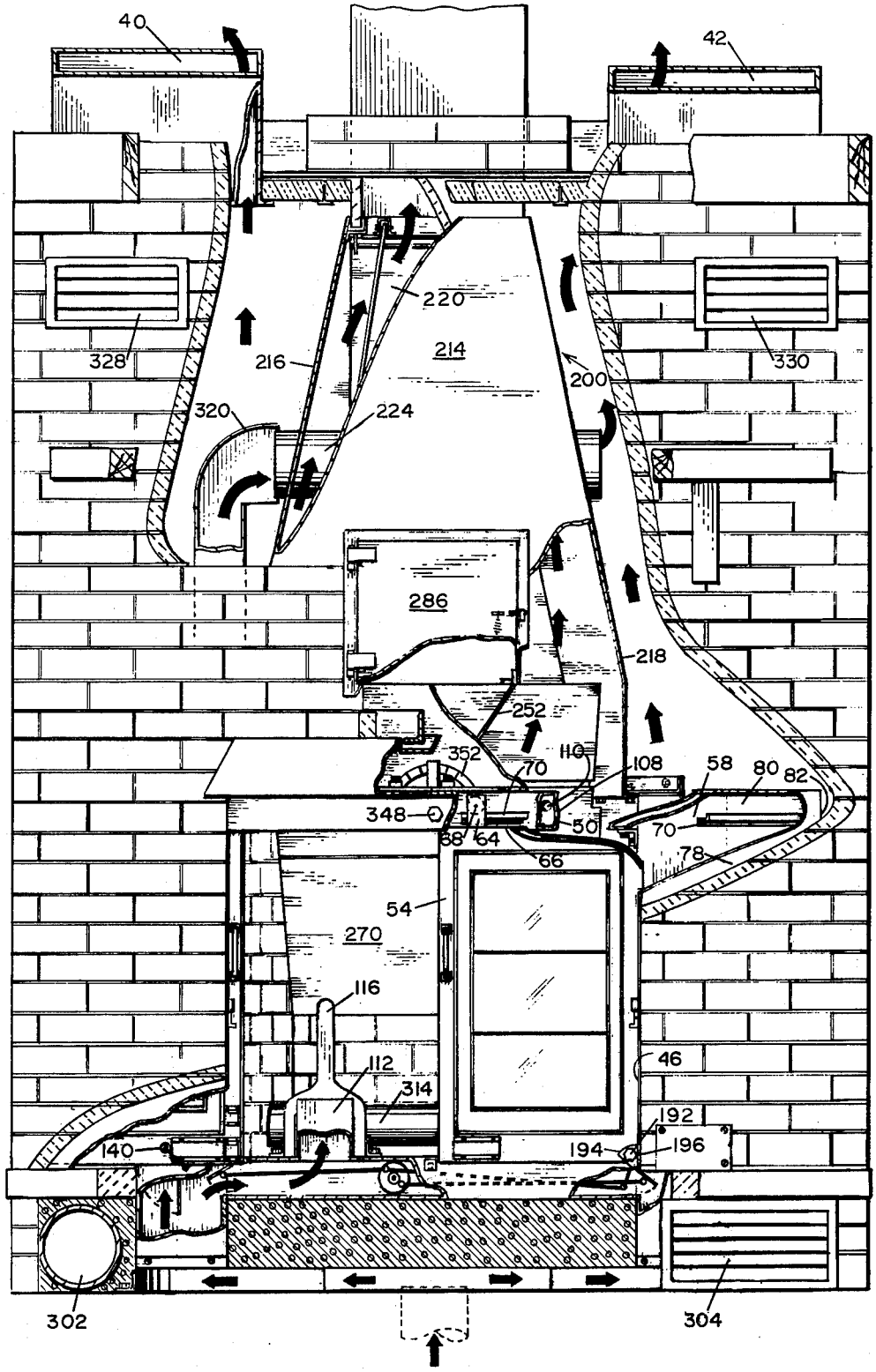
FIG. 2 is a front elevation view of the fireplace heating system of FIG. 1 with portions thereof cutaway to show various features of the invention.
Figure 2A:
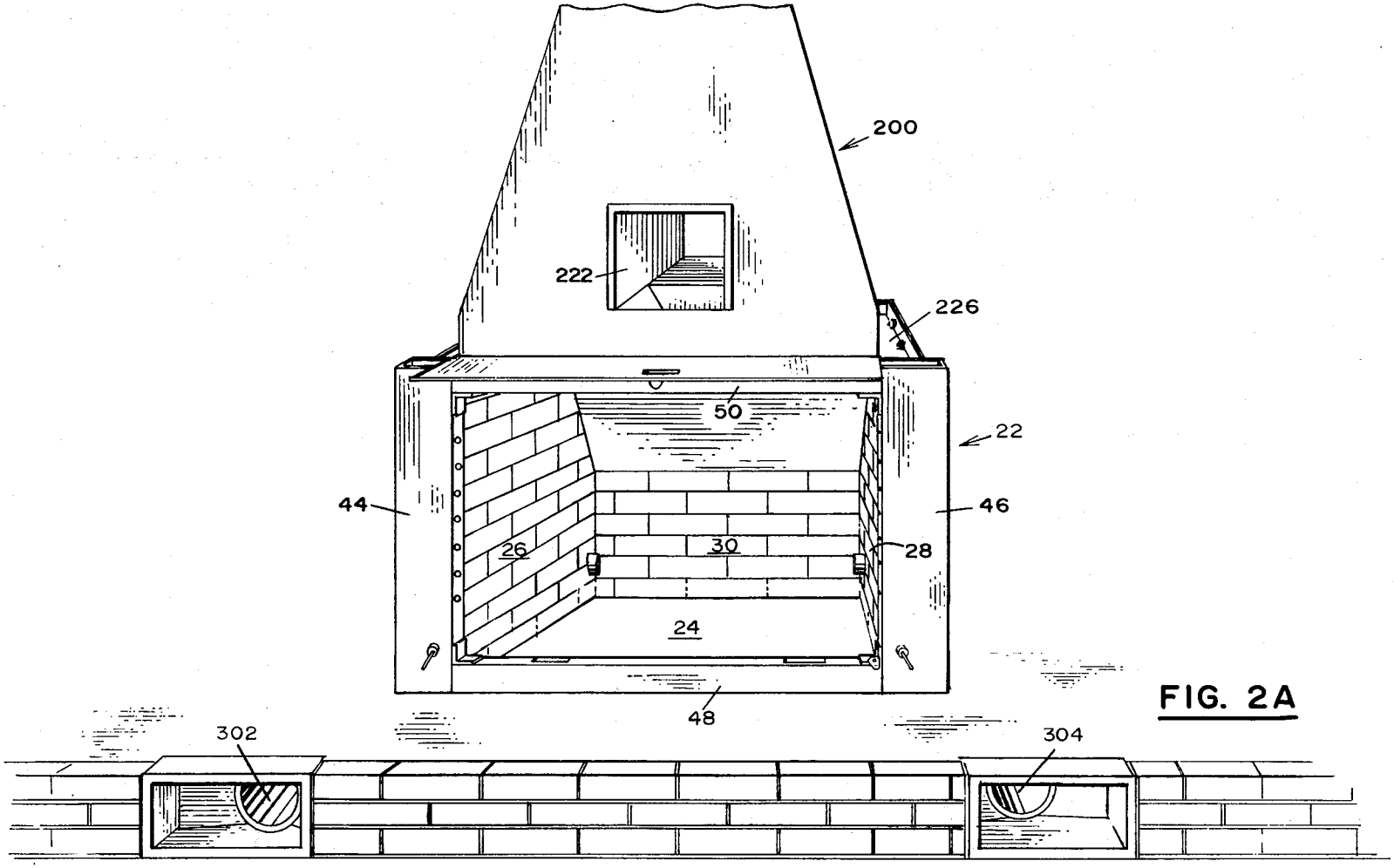
FIGS. 2A, 2B, 2C and 2D are representations of portions of the fireplace system shown in FIG. 2, showing various features of the invention.
Figure 2B:
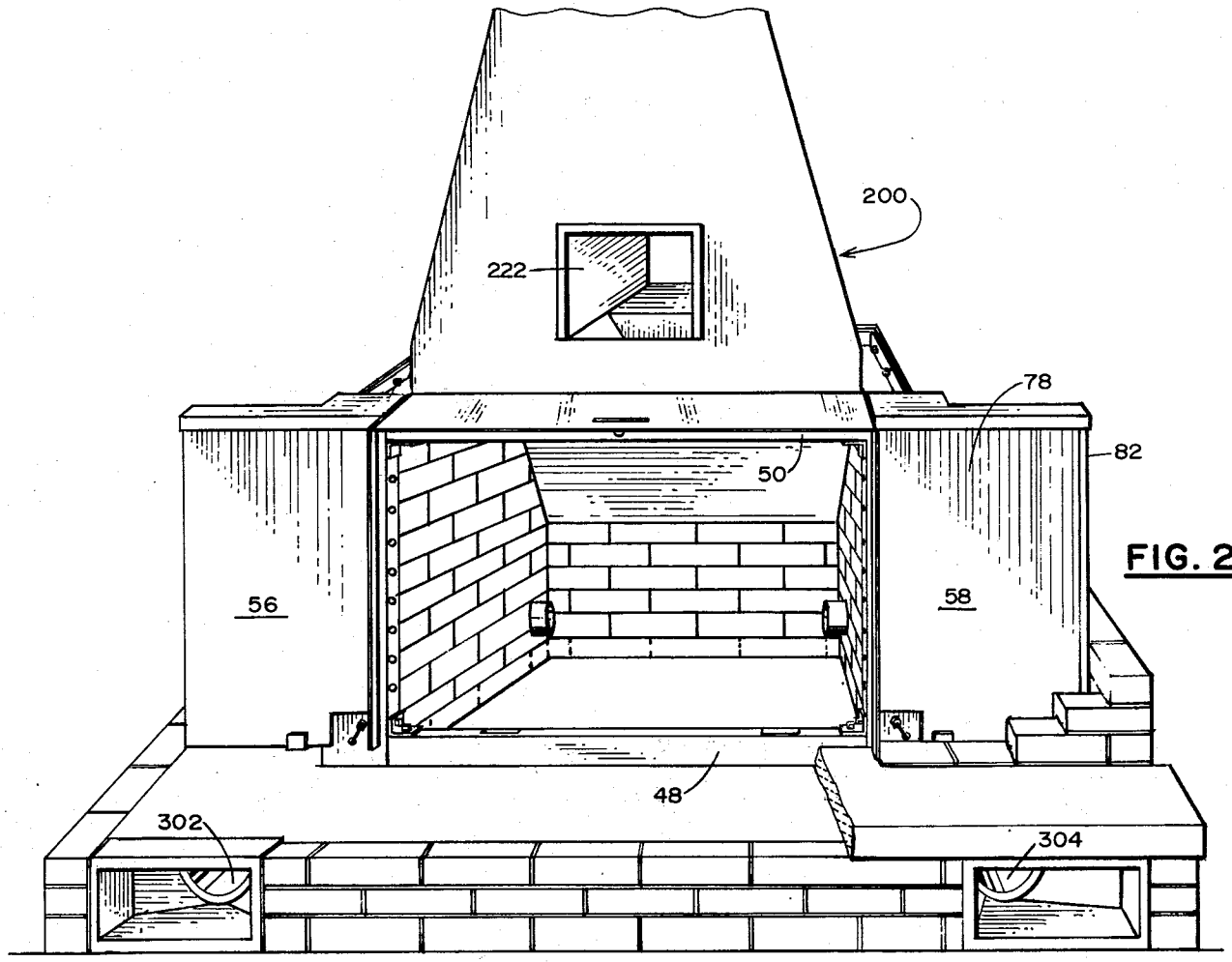

Referring to the Figures, in FIG. 1, there is depicted in frontal view, a fragmentary portion of a wall 20 into which there is built the present fireplace system. In the illustrated embodiment, the fireplace, indicated generally at 22, is recessed into the wall 20 in the usual manner and comprises a floor 24, side walls 26 and 28 and a rear wall 30. In the depicted embodiment, these walls are made of firebrick. The side and rear walls 26, 28 and 30, respectively, rest on the floor 24 and are spaced from the chimney side walls 32 and 34 and the chimney rear wall 36 (FIGS. 2D and 3) to define an open space 38 between the fireplace walls and the chimney walls. As will be noted hereinafter, this open space defines a passageway for the flow of fresh air past selected elements of the disclosed system and for directing heated air to outlet conduits 40 and 42 (FIG. 2).

In the illustrated system, jamb members 44 and 46, a sill 48 and a plate 50 define the perimeter of the front opening of the fireplace. These members are secured by appropriate fasteners to the front faces of the side walls 26 and 28 of the fireplace.

The front opening of the fireplace 22 is closable by panel means, such as doors 52 and 54, each of which is adapted to be slidably moved laterally of the fireplace opening into appropriate housings 56 and 58 mounted behind the wall 20 and in front of the jambs 44 and 46, the sill 48, and the plate 50. Each of the depicted doors is of a relatively fireproof material and comprises a central panel 60 and peripheral frame means 62. The upper end of each door is provided with a plurality of brackets 64, each of which extends upwardly from the top edge 66 of the door and receives therein a roller 68 that engages and rolls along an elongated horizontal track 70 mounted on and projecting from the plate 50 to support the door for sliding movement between its open and closed positions with respect to the front opening of the fireplace.

The two doors 52 and 54 in the illustrated embodiment abut at their respective vertical edges 72 and 74 when in their closed positions. In the preferred embodiment, one of the door edges, edge 74 for example, is provided with a flat strip 76 on the front face of the door and extending along the vertical height of the door and projecting horizontally therefrom. When the doors are closed, the edge 72 of the other door 54 lies behind the projecting portion of the strip 76 to more completely seal the abutting faces of the doors. As will appear more fully hereinafter, this structural arrangement further functions in cooperation with a latch mechanism for the doors.

As depicted in the Figures, each of the doors is received in a housing mounted behind the wall 20, one housing on each of the opposite sides of the fireplace. Each of the illustrated housings includes a front wall 78, a rear wall 80 and an end wall 82 which acts as a stop for the door when it is rolled into its respective recessed housing upon movement of the door toward its open position.

Referring particularly to FIGS. 2, 2A, 3 and 9, the jamb members 44 and 46, the sill 48 and the plate 50 that define the perimeter of the front opening of the fireplace, each comprises a hollow tubular member through which air can be fed selectively into the fireplace. These members, in turn, are connected in fluid communication with a source of air outside the room that contains the fireplace. This is accomplished in the illustrated embodiment, by connecting one end 84 of the sill 48 to the bottom end 86 of its adjacent jamb 46 that is connected in fluid communication with one end 88 of a header 90 that extends across the front of the fireplace (FIGS. 2C and 9) and leads to an outside air source. The opposite end 92 of the sill 48 and the bottom end 94 of its adjacent jamb 44 are connected to the opposite end 96 of the header 90 so that outside air is available at both ends of the sill and the bottom ends of the jambs. The top ends 98 and 100 of the jambs 44 and 46, respectively, are joined in fluid communication with the opposite ends 102 and 104 of the tubular plate 50 to thereby provide air access to the plate. As illustrated, each of the jambs is provided with spaced perforations 106 along one of their sidewalls facing inwardly of the fireplace so that air flowing through these members is free to exit into the fireplace proper. In similar manner, the rear wall 108 of the plate 50 is provided with openings 110 through which air passes into the fireplace (FIG. 2). Such influx of air is controlled, as will appear hereinafter, to reduce the inflow of room air into the fireplace through its open front, to aid in controlling a fire in the fireplace and tempering of the temperature of the flue gases exiting through the chimney.

As depicted, air is selectively admitted to the base of a fire in the fireplace by means of ducts 112 and 114 leading from the tubular sill 48 at locations adjacent the usual locations of andirons 116. Preferably, these ducts 112 and 114 have their outboard ends disposed underneath the andirons for protecting the ducts against physical damage as by being crushed under the weight of firelogs or the like.

Figure 2C:
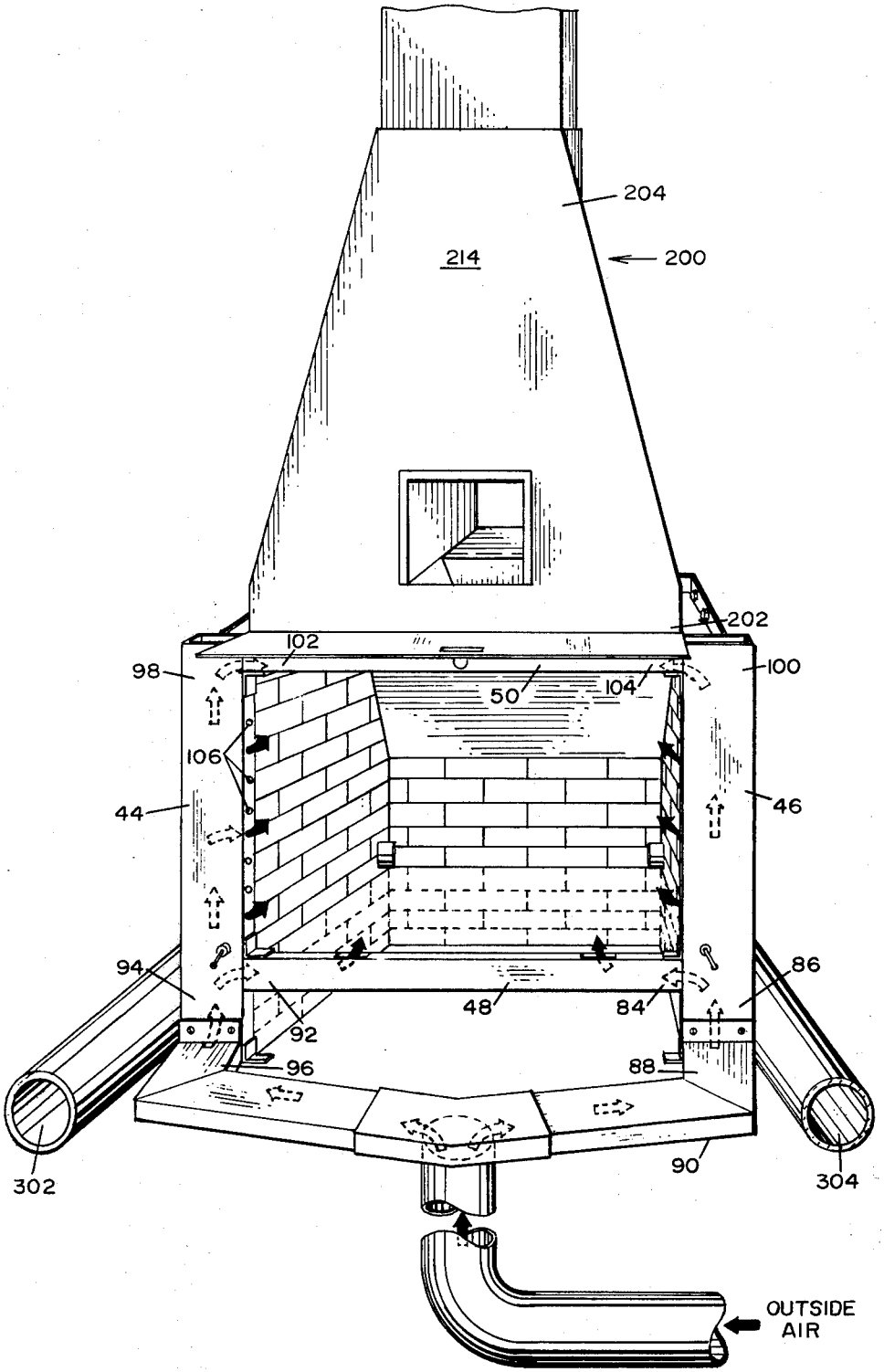
Figure 2D:
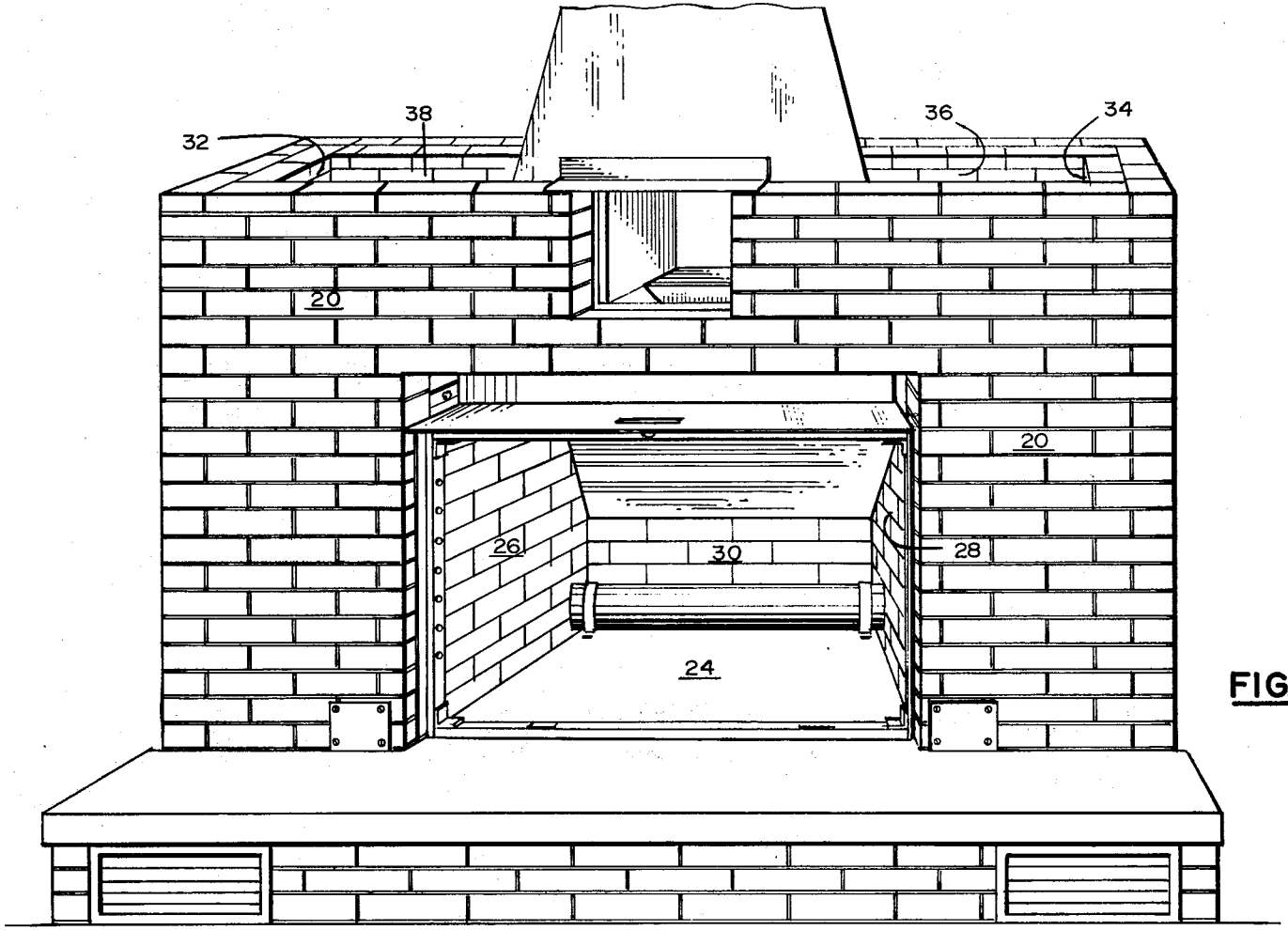
Figures 9, 10, 11, 12, 13, 14:
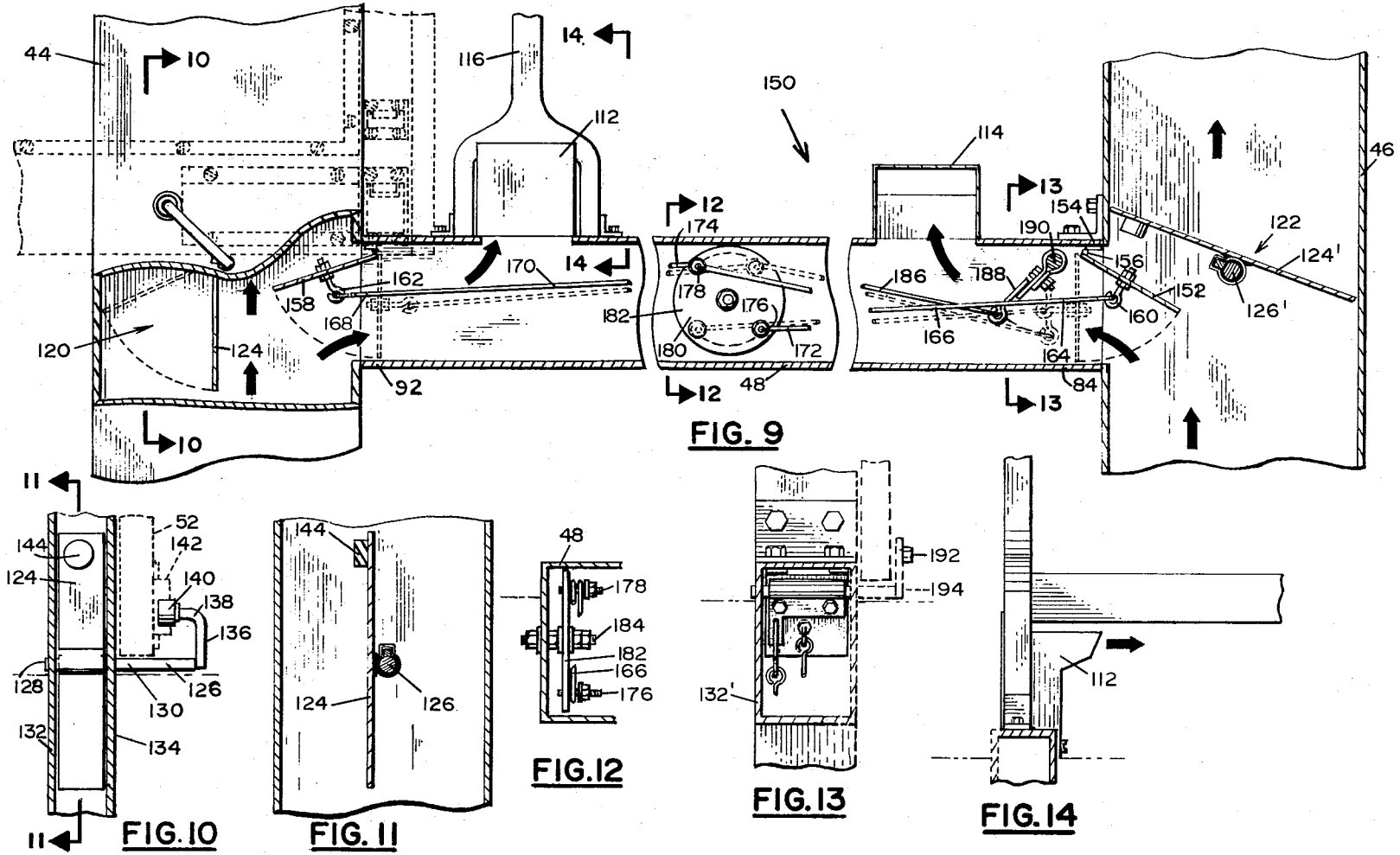
FIG. 9 is a fragmentary sectional view, part cutaway, of the sill and bottom portions of the jamb members, and their respective damper means, of the disclosed system.
FIG. 10 is a sectional view taken along the line 10—10 of FIG. 9.
FIG. 11 is a sectional view taken along the line 11—11 of FIG. 10.
FIG. 12 is a sectional view taken along the line 12—12 of FIG. 9.
FIG. 13 is a sectional view taken along the line 13—13 of FIG. 9.
FIG. 14 is a sectional view taken along the line 14—14 of FIG. 9.
Figure 15:
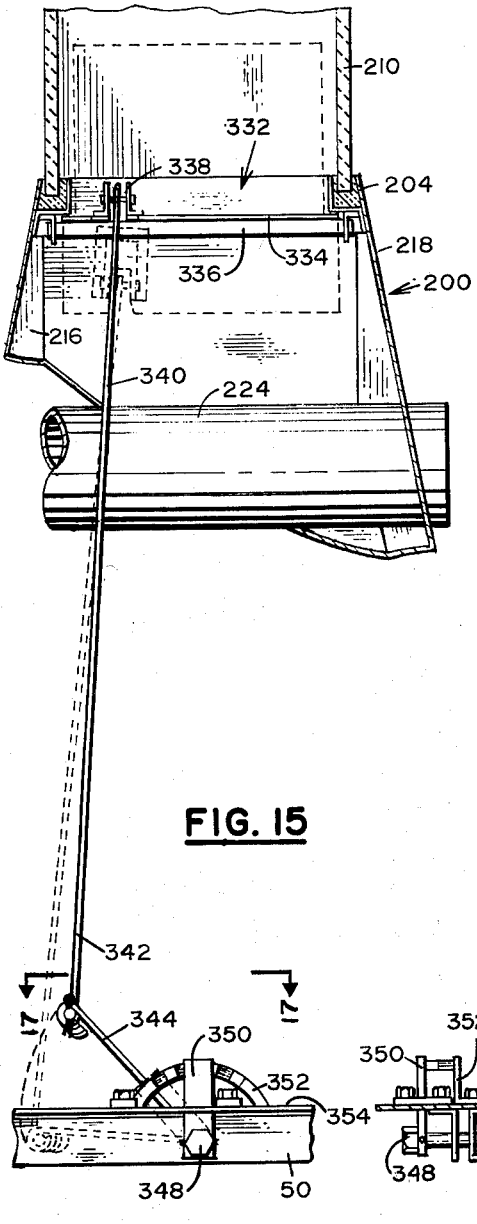
FIG. 15 is a fragmentary, front elevation sectional view of a hood damper means.
Figure 16:
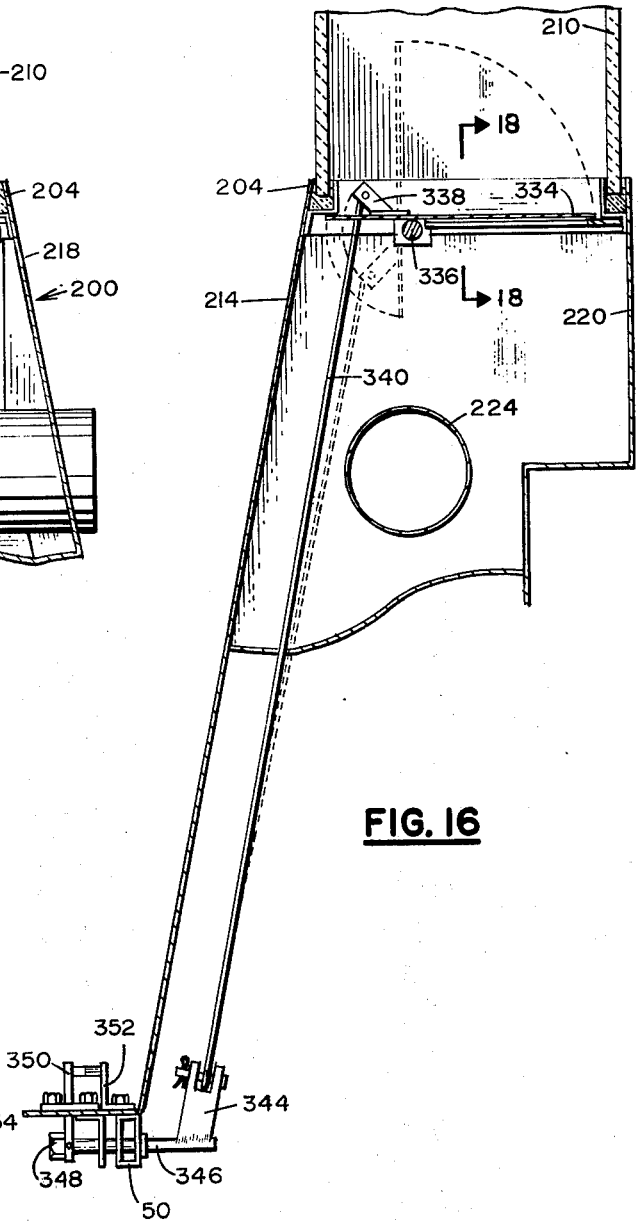
FIG. 16 is a side elevation view of the hood damper means shown in FIG. 15.
Figure 17:
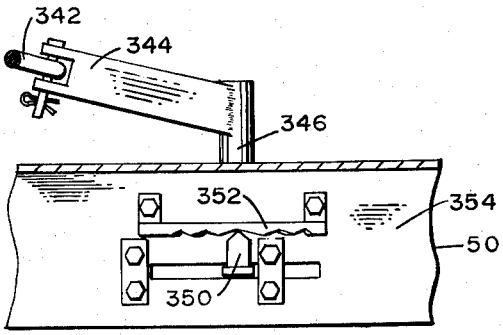
FIG. 17 is a sectional view taken along the line 17—17 of FIG. 15.

As shown in FIGS. 2C and 9, the flow of air to the jambs 44 and 46, hence to the plate 50, indicated by the arrows in FIG. 2C, is controlled by jamb damper means 120 and 122 provided in the bottom end of each of the jambs. Each jamb damper means includes a damper blade 124 proportioned for sealing the jamb against air flow therethrough when the blade is disposed generally transversely of the longitudinal axis of the jamb, i.e., when the blade is oriented substantially horizontally in FIG. 9, such position being termed the closed position. The blade 124 is rotatably mounted within its respective jamb 44 as by a shaft 126 located substantially along the transverse centerline of the blade 124 and whose opposite ends 128 and 130 are mounted in the opposite walls 132 and 134 of the jamb 44. The shaft 130 projects through to the outside of the wall 134 and has connected to its projecting portion, an arm 136 whose movement serves to rotate the shaft 130 to close the damper means 120. The outboard end 138 of the arm 136 is provided with a roller 140 extending from the arm and across the path of movement of the door 52 in position to be engaged by a block 142 mounted on the front face of the door as the door is moved toward its open position. The angular relationship between the arm 136, the shaft 126 and the blade 124 is such that when the door 52 is open, as when a fire is burning in the fireplace, the block 142 engages the roller 140 and the damper is open to permit maximum air flow to the jamb 44 and to the end 102 plate 50. A counterweight 144 is mounted on one surface of the blade 124, as shown in FIG. 10, to bias the blade toward its closed position. When the door 52 is closed, the block 142 is disengaged from the roller 140 thereby freeing the arm 136 for rotation and allowing the damper blade 124 to close under the influence of the counterweight 144 and shut off the flow of air to the interior of the fireplace through the jamb 44 and the end 102 of the plate 50.

The flow of outside air through the sill 48 to the fire in the fireplace is controlled in the depicted embodiment by a sill damper means 150. As shown in FIG. 9, one of the opposite ends 84 of the sill 48 is provided with a damper blade 152 hingedly mounted on the upper wall portion 154 of the end of the sill 48 and dimensioned to substantially close the interior of the sill end when the blade hangs generally vertically downwardly from the hinge 156. The opposite end 92 of the sill 48 is similarly closed by a damper blade 158 hinged to and depending from the upper wall 154 of the sill. Each of the damper blades 152 and 158 is provided with an eye bolt 160 and 162, respectively, to which there is connected one end 164 of a control rod 166, in the case of the damper blade 152. One end 168 of a further control rod 170 is connected to the eye bolt 162 in the damper blade 158. The opposite ends 172 and 174 of the rods 166 and 170, respectively, are connected to pins 176 and 178 projecting from the face 180 of a plate 182 that is rotatably mounted upright within the sill 48 and with its plane substantially aligned with the longitudinal axis of the sill. A shaft 184 extending between the walls of the sill, and to which the plate is fixed, serves to so mount the plate for rotation about its center.

To regulate the flow of air into the sill 48 through the positioning of the dampers 152 and 158, the plate 182 is connected by a rod 186 to a link 188 which, in turn, is secured to and rotatable with a shaft 190 that is mounted across the width of the sill 48 adjacent the end 84 thereof. One end of the shaft 190 projects from the front face of the sill and is provided a generally triangular lug 194 to which there is attached a nut 192. Through the means of a wrench applied to the nut 192, the lug 194 is rotated to also rotate the shaft 190, hence rotate the plate 182. As recognized from FIG. 9, the pins 176 and 178 are disposed 180 degrees apart and adjacent the periphery of the plate 182. Further, as shown by the dotted lines of FIG. 9, rotation of the plate 182 actuates the control rods 166 and 170 to open or close the dampers 152 and 158 simultaneously and to the same degree, thereby regulating the flow of air to the sill.

As noted above, air entering the hollow sill 48 is discharged into the fireplace through a set of ducts 112 and 114, each of which preferably is disposed beneath an andiron 116 and whose end opens inwardly of the fireplace. In this manner, outside air is injected into the immediate vicinity of a fire in the fireplace, the quantity of which is selectable by adjustment of the dampers 152 and 158. The limit of travel of the dampers toward their closed positions is set by the generally triangular lug 194 (FIG. 2) fixedly secured to the shaft 190 and disposed at the junction of the end 84 of the sill 48 and the jamb 46 such that when the lug 194 is rotated to open the dampers 152 and 158, one side 196 of the lug 194 comes to bear against the jamb 46 when the dampers 152 and 158 are in their full open position (as shown in FIG. 2).

Figure 18:
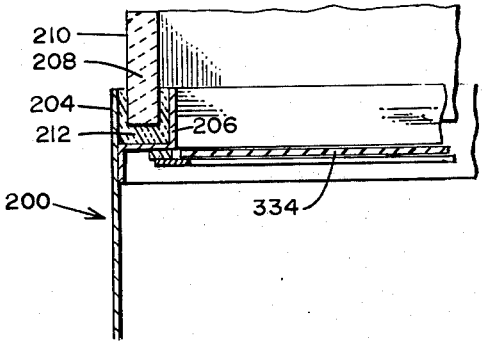
FIG. 18 is a fragmentary sectional view taken along the line 18—18 of FIG. 16.

As illustrated in the several Figures, the present fireplace system includes a hood means 200 disposed above and with its open bottom end 202 covering the top opening of the fireplace and therefore in position to receive the flue gases and/or other combustion products leaving the fireplace through the top opening thereof. As shown in FIG. 18, the top end 204 of the hood 200 is open and provided with a peripheral trough 206 into which there is received the bottom end 208 of a flue tile 210. As desired, a quantity of glass wool 212 or the like may be provided in the trough 206 to seal the joint between the tile and the hood (FIG. 18). As thus disposed, the hood means also is in position to be heated by heat rising from the fireplace.

The depicted hood comprises a front panel 214, side panels 216 and 218, and a rear panel 220. The front and rear panels are provided with openings into which there is inserted an oven member 222 that provides for fluid communication between the rear and the front of the hood. The hood is further provided with one or more ducts 224 that extend between and project from the opposite sides 216 and 218 of the hood for purposes which will appear hereinafter.

As illustrated, the hood is removably mounted in its covering position over the top opening of the fireplace by means of a peripheral flange 226 that is adapted to be received on the top surfaces of the side walls 26 and 28, and the rear wall 30 of the fireplace. In one embodiment, this flange is anchored to the fireplace wall by means of a planar member 228 whose lower extremity is bent horizontally inwardly and received within the mortar joint between adjacent bricks of the fireplace walls. The upper edge 230 of the planar member is joined to the hood flange as by bolts 232. The inner edge of the flange 226 is joined to the bottom edge 202 of the hood as by means of bolts 234 so that the hood is removably held in its covering position over the top opening of the fireplace. The front edge 236 of the hood is provided with a horizontal shelf 238 that extends over the plate 50 and projects through the wall 20. This shelf 238 is removably connected, as by bolts 240, to one leg 241 of an elongated channel member 242 that extends horizontally across the top edge of the fireplace to define a heat deflector. The other leg 244 is received through the wall 20 in frictional engagement with an angle iron support 246. When the hood is to be removed from the system, this heat deflector is disconnected from the hood.

The interior of the hood 200 is generally hollow so that gases and other combustion products from the fireplace pass upwardly through the hood and exit through the chimney 250. The interior of the hood, as noted above, is provided with an elongaged oven member 222 extending between the front and rear of the hood. The interior of the hood is further provided with a diverter shield 252 which divides the gaseous stream flowing upwardly from the fireplace into two streams, one of which passes to either of the opposite sides of the oven member 222, thence through the remainder of the hood and out of the chimney.

Figure 5:
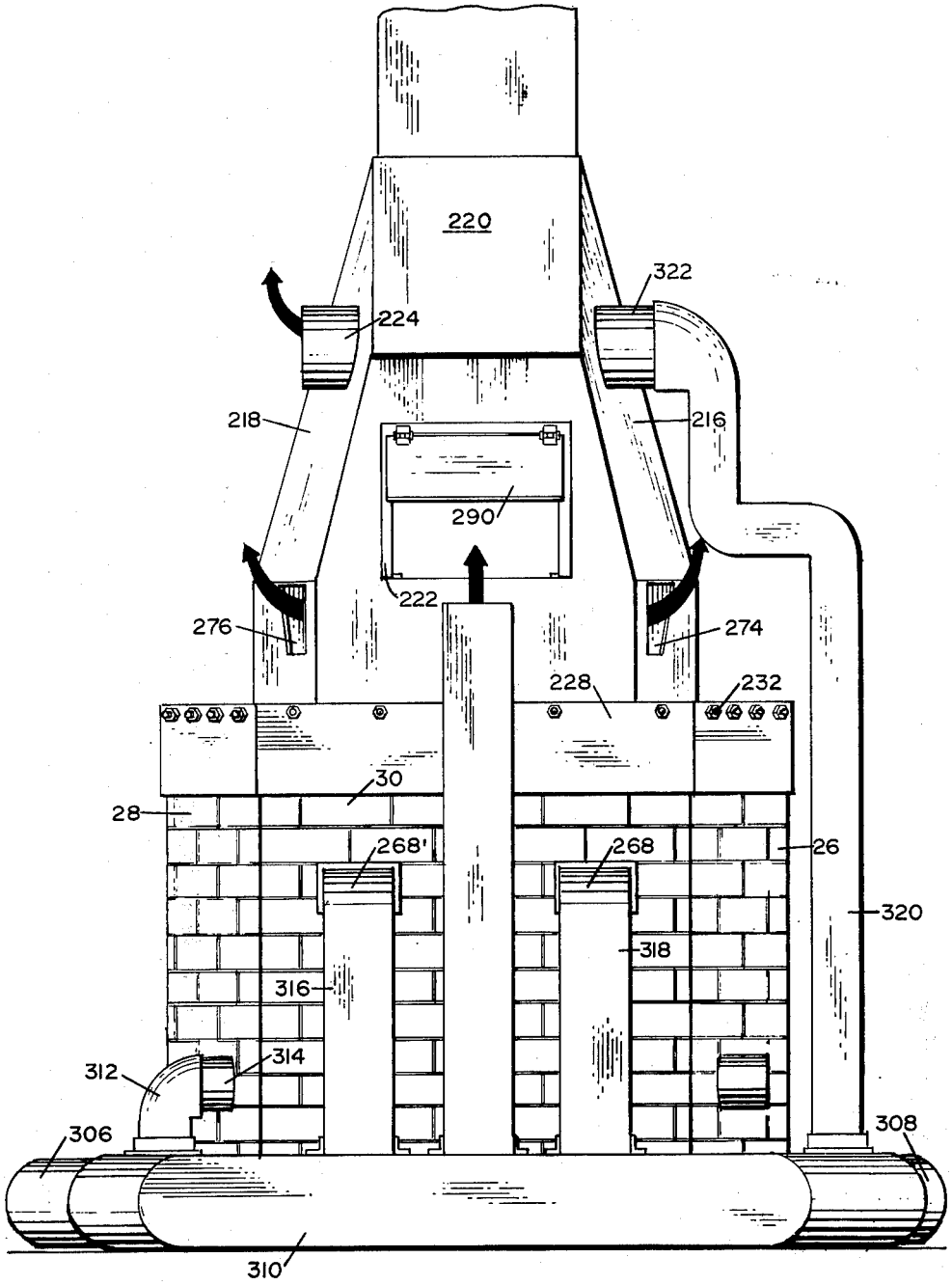
FIG. 5 is a rear elevation view of a portion of the disclosed fireplace heating system, with the surrounding chimney removed, showing the air flow and heating feature of the invention.
Figure 6:
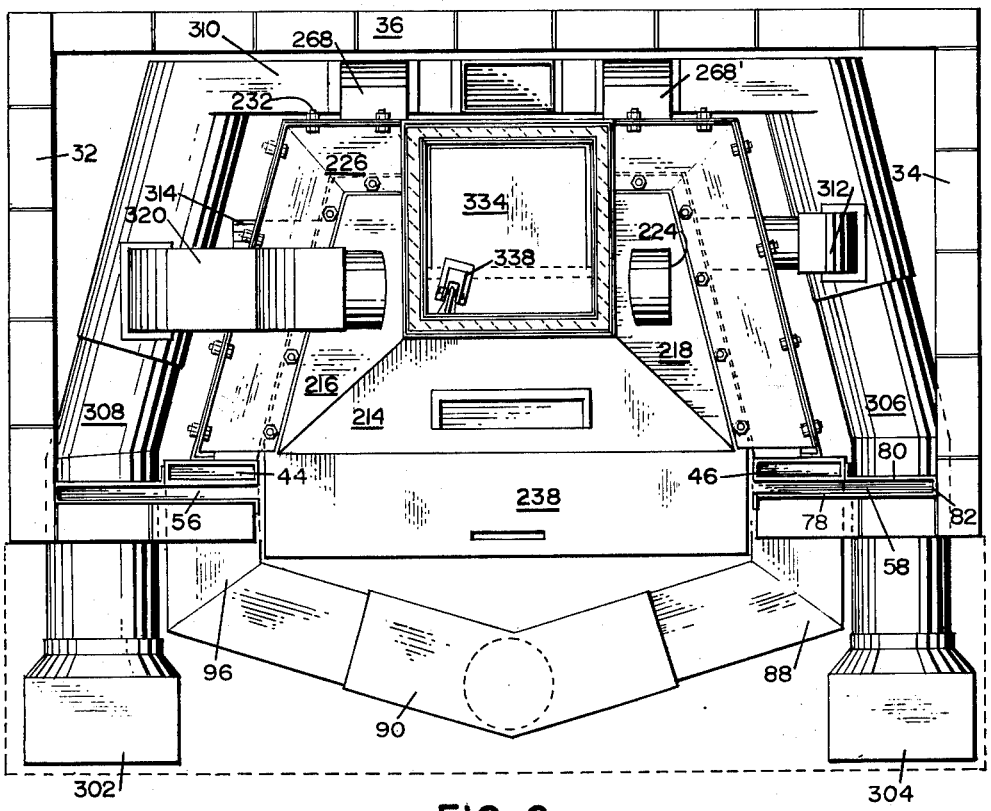
FIG. 6 is a top view of the system portion shown in FIG. 5.

The lower rear portion of the hood is provided with a duct 254 extending transversely across the rear bottom portion of the hood and defining an air flow channel through this portion of the hood. The forward wall 256 of this duct is protected against excessive heating by means of a heat resistant material such as an iron plate 258 that extends fully across the width of the hood to protect the duct 254. The bottom wall 260 of the duct 254 is provided with one or more inlet ducts 262 projecting downwardly toward the fireplace opening. This inlet duct is connected in fluid communication, by means of an extension duct 264, to a further duct 266 that extends transversely of the fireplace and which is in fluid communication with the exterior of the rear wall of the fireplace as by means of a further duct 268 extending through the rear fireplace wall 30. The duct 266 and the extension 264 are protected from excessive heat of the fireplace by metal panels 270 and 272 that extend fully across the rear of the fireplace. It may be visualized that air entering the duct 268 disposed in the rear wall of the fireplace flows into the transverse duct 266 where it is heated and fed upwardly through the extension 264, thence through the inlet 262, and into the interior of the duct 254 that extends transversely across the rear of the hood 200. As such air flows through these ducts, it is heated. The air is further heated as it passes through the duct 254 to exit the outlet ports 274 and 276 into the space 38 between the hood and the chimney walls. As shown by the arrows in FIGS. 2 and 5, this air passes upwardly through the space 38 to leave the fireplace system through outlet ducts 40 and 42 to an area to be heated. As will appear more fully hereinafter, the ducts 40 and 42 may lead to a central heating system for a building.

Figure 3:
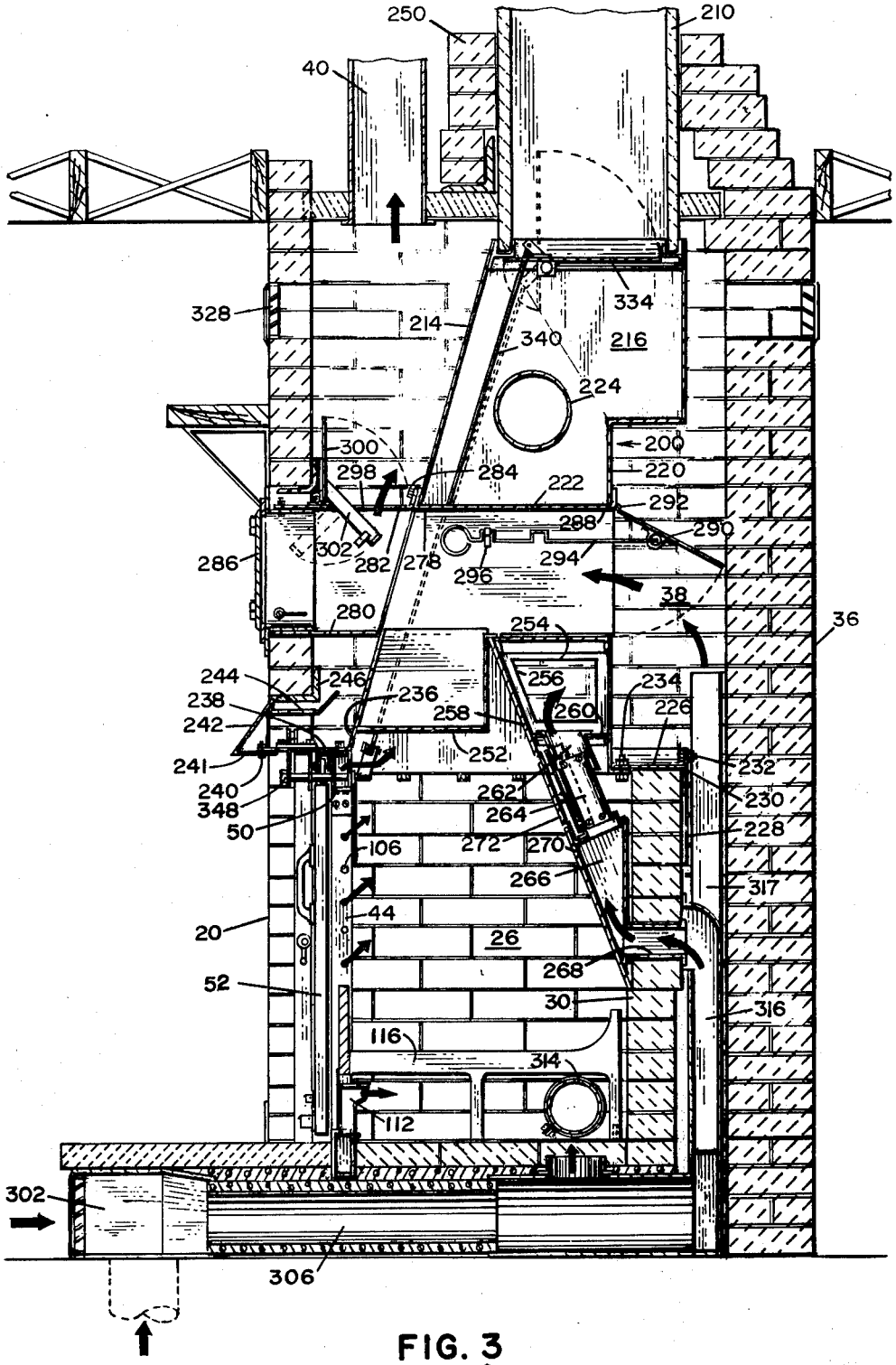
FIG. 3 is a side elevation view of the system of FIG. 2.

As best seen in FIG. 3, the forward end 278 of the oven member 222 mounted in the hood is provided with an extension member 280 whose rear end 282 is fastened to the front panel 214 of the hood as by bolts 284 and which extends therefrom through the wall 20. The forward end of the extension member 280 is provided with an oven door 286 by means of which access may be gained to the interior of the oven member 222. The rear end 288 of the oven member preferably is provided with a damper 290 hinged at its upper end 292 for movement between open and closed positions with respect to the rear end of the oven member. Opening and closing of the damper 290 is accomplished by means of a control rod 294, one end of which is connected to the damper 290 and the other end of which is provided with appropriate bent portions that fit over a lug 296 to maintain the damper in either its open or closed position, as desired. When the damper 290 is in its open position, as best seen in FIG. 3, air rising within the space 38 between the hood and the chimney wall, is diverted into the oven. This air is permitted to leave the oven through an opening 298 provided in the extension member 280. This latter opening 298 is provided with a cover member 300 to which there is attached a depending arm 302. Upon opening of the oven door 286, this depending arm is readily grasped and pushed to open the cover 300 and thereby provide for air movement through the oven member 222.

To enhance the utilization of the heat generated in the fireplace and which flows upwardly out of the fireplace toward the chimney 250, the present inventor provides a novel system for circulation of air from an area to be heated, through the fireplace system, thence to be returned to the heated area. In the illustrated embodiment, this is accomplished by means of a system of ducting that includes inlets 302 and 304 disposed on opposite sides of the fireplace. These inlets lead to side ducts 306 and 308 that, in turn, are connected in fluid communication with a rear duct 310. As shown in the several Figures, air is extracted from the side duct 306 and directed by an elbow duct 312 through a tubular duct 314 disposed adjacent the bottom of the fireplace. Air passing through this tubular duct 314 is heated and exits into the space 38 between the fireplace and the chimney walls, thence to exit through the ducts 40 and 42 to an area to be heated.

In addition, air is extracted from the rear duct 310 and fed through ducts 316 and 318 to the inlets 268 and 268' leading through the rear wall of the fireplace into the transverse duct 266, thence into the duct 254 extending transversely across the bottom rear of the hood to be heated and discharged through the outlet ports 274 and 276 of the duct 254 into the space between the hood and the chimney wall as noted above.

Still further, air is extracted from the side duct 308 and fed through a duct 320 to one end 322 of the duct 224 that extends transversely between the sides of the hood. By reason of this duct 224 extending across the upward flow path of the heated flue gases, it is heated so that the air that passes therethrough is likewise heated prior to its being discharged into the space 38 between the hood and the chimney for discharge through the ducts 40 and 42. It will be recognized that additional transverse ducts like duct 224 can be employed, but only one is shown to simplify the illustration.

If desired, one or more air circulating fans may be installed in the ducting system for withdrawing air from outside the fireplace system via the inlets 302 and 304, and forcing the flow of the air through the several ducts as described hereinabove. Alternatively, or in addition, blower fans may be provided in the ducts 40 and 42 that receive heated air for directing it to the area to be heated. It will be understood that the ducts 40 and 42 may readily be connected into a central air conditioning system for a building so that air heated upon its passage through the disclosed system may be employed to heat rooms located remotely from the fireplace. Additionally or alternatively, the heated air rising within the space 38 between the hood and chimney may be directed through the wall 20 via openings 328 and 330 into the room in which the fireplace is located.

The flow of flue gases upwardly through the hood 200 is regulated by a damper means 332 comprising a plate member 334 fixedly secured to a shaft 336 that extends transversely between the side walls 216 and 218 of the hood at a location adjacent the top of the hood. The shaft 336 is provided with a bifurcated connector 338 to which there is connected a rod 340 that depends from the damper means downwardly to be connected at its lower end 342 to an arm 344 which is a lateral extension of a shaft 346 mounted in the plate header 50. One end of the shaft 346 projects from the forward face of the plate and is provided with a nut 348 so that rotation of the nut, as by a tool, functions to rotate the shaft 346 and to open or close the damper means 332. A friction arm 350 secured on the shaft 346 engages a notched bar 352 mounted on the top surface 354 of the plate 50 to aid in holding the rotational position of the shaft 346, hence the position of the plate member 334.

Figure 4:
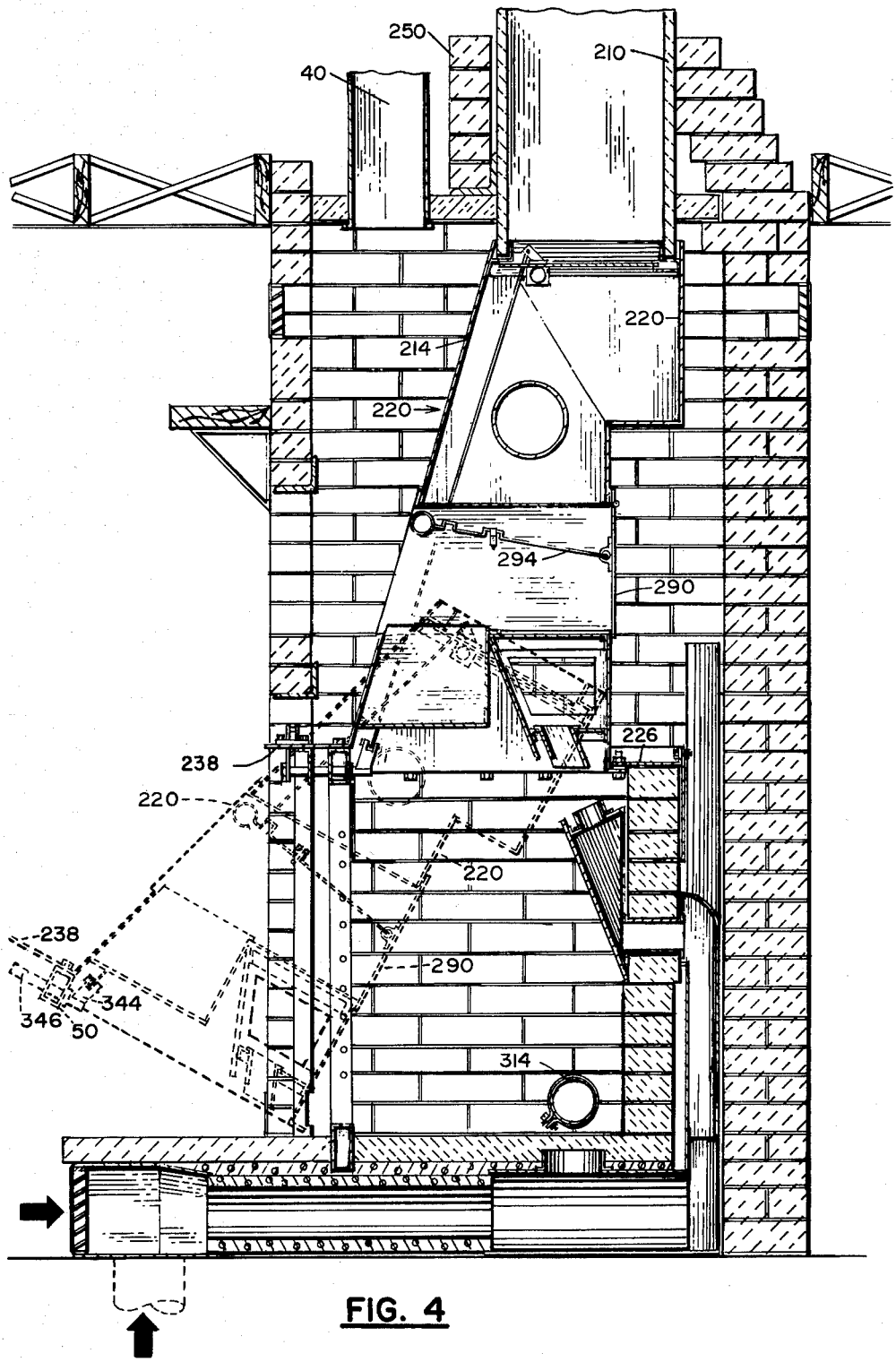
FIG. 4 is a side elevation view of the system of FIG. 2 and showing, in phantom, the hood removal feature of the invention.

As depicted in FIG. 4, the hood 200 may be removed from the system by removing the bolts 234 and 240, removing the deflector 242, disconnecting the opposite ends of the plate header 50 from the upper ends of the jambs 44 and 46 and thereafter withdrawing the hood from the fireplace through its front opening. This capability of removal is advantageous for cleaning purposes and/or hood replacement.

Figure 7:
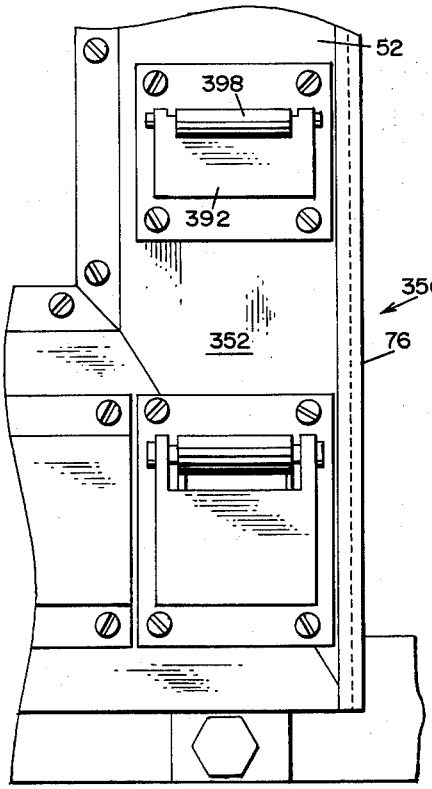
FIG. 7 is a fragmentary view of the front bottom right hand corner of the closure panel shown in FIG. 1 and depicting the latch feature of the invention.
Figure 8:
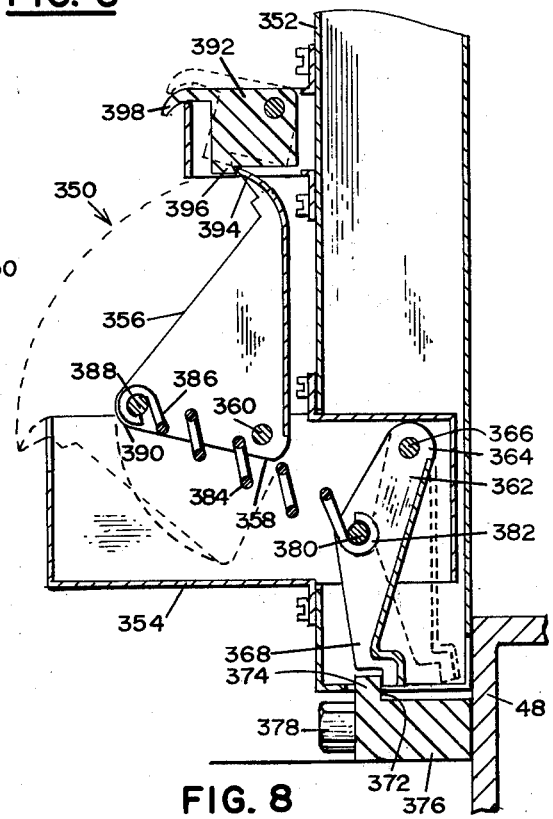
FIG. 8 is a sectional view of the latch feature shown in FIG. 7.

As described hereinabove, the doors 52 and 54, when closed, effectively close off the flow of air to the interior of the fireplace. This function is enhanced by means of a latch 350 (FIGS. 1, 7 and 8) mounted on the front face 352 of the door 52 which serves to enhance the seal between the abutting faces of the doors. In the illustrated embodiment, the latch includes a housing 354 mounted on the front face of the door 52 at a location near the bottom corner of the face of the door. Within the housing 354, there is pivotably mounted a catch arm 356 of generally triangular geometry, the pivotal mounting being at one of the corners 358 of the arm by means of a shaft 360 that extends across the housing 354. The housing extends into the body of the door where it further receives a friction lever 362 pivotally mounted at one of its ends 364 on a shaft 366 that extends across the width of the housing. The opposite and free end 368 of the friction lever 362 is adapted to engage the rear face 372 of an upright shoulder 374 on a block 376 that is mounted on the front face of the sill 48 as by a bolt 378. The friction lever 362 is provided with a pin 380 at the approximate midpoint of the lever to receive one end 382 of a spring 384 whose opposite end 386 is received by a pin 388 provided on the corner 390 of the catch arm 356, thereby connecting the catch arm with the friction arm such that when the catch arm is pivoted upwardly (dotted lines of FIG. 8), the spring 384 is tensioned to pull the friction lever 362 into engagement with the lug 374 and produce a reactive force at the shaft 366 that urges the door 52 rearwardly toward the sill 48. By reason of the elongated strip 76 provided on the door 52 and which overlies the leading edge of the abutting face of the door 54, the latching action referred to above functions to urge the strip 76 against the door 54 and thus maintain both doors in frictional engagement with the sill 48 to inhibit their being opened.

The catch arm 356 is held in its latched position by a gravity catch 392 pivotally mounted on the door face immediately above the housing 354 and in position for the outboard edge 394 of the catch arm to be caught and held by a depending shoulder 396 on the catch 392. The catch 392 is releasable by applying a lifting force to a projection 398 provided on the front face of the catch to thereby free the catch arm.

While a preferred embodiment has been shown and described, it will be understood that there is no intent to limit the invention by such disclosure, but rather, it is intended to cover all modifications and alternate constructions falling within the spirit and scope of the invention as defined in the appended claims.

What is claimed is:

1. In a heating system including a fireplace having a front opening, a top opening and a chimney having a bottom opening, the improvement comprising hood means interposed in substantially free-standing relationship between said top opening of said fireplace and said bottom opening of said chimney and including wall means defining a passageway for flue gases and the like from said fireplace to said chimney, said passageway having a major dimension oriented generally upwardly from the top opening of said fireplace to said bottom opening of said chimney and being inclined with respect to the vertical whereby a substantial surface area of said wall means extends obliquely upwardly and across a substantial portion of the flow path of said flue gases as said flue gases pass upwardly through said passageway and said surface area of said wall is thereby heated, said wall means further defining a bottom peripheral edge substantially coterminal with said top opening of said fireplace, said hood means having cross-sectional dimensions less than the corresponding cross-sectional dimensions of said top opening of said fireplace such that said hood means is withdrawable through said top opening, flange means detachably secured to at least a major portion of the peripheral dimension of said bottom peripheral edge of said wall means and extending generally outwardly therefrom to engage said top opening of said fireplace and at least partially support said hood above said top opening of said fireplace, whereby said hood is removable through said top opening of said fireplace when said bottom edge of said wall means is detached from said flange means, housing means exterior to said hood means and extending between said fireplace and said chimney to enclose the space therebetween, said housing means being spaced apart from said hood means and cooperating therewith to define an air flow passageway exteriorly of said hood means and between said hood means and said housing means, duct means pneumatically connecting said passageway between said housing means and said hood means with a source of air remote from said fireplace, and further duct means pneumatically connecting said passageway with a remote location at which heat is desired, whereby air passing through said passageway is heated by reason of its proximity of said surface of said hood means and passed to said remote location.

2. The heating system of claim 1 including heat exchanger means comprising a duct extending generally horizontally across said hood means in the flow path of said flue gases through said hood and defining a flow path, within said hood means but separated from said flue gases, for air from said remote source, said flow path extending from one side to another side of said hood means.

3. The system of claim 2 and including further duct means disposed in the bottom rear portion of said fireplace and extending between the side walls thereof with one end of said further duct means defining an inlet that is connected in fluid communication with said remote source of air and with the opposite end thereof communicating with said passageway.

4. The heating system of claim 1 wherein said wall means includes a peripheral bottom edge shelf portion extending generally outwardly from said wall means at a location juxtaposed to the top edge of said front opening of said fireplace and interposed between said top edge of said front opening and the interior of said fireplace.

5. The heating system of claim 4 and including a hollow tubular member secured to said bottom peripheral edge shelf portion and extending transversely across the top edge of the front opening of said fireplace and interposed between said shelf portion and the interior of said fireplace.

* * * * *